US008091724B2

(12) United States Patent
King

(10) Patent No.: US 8,091,724 B2
(45) Date of Patent: Jan. 10, 2012

(54) CONTAINER CLOSURE ASSEMBLY WITH INTERNAL NECK THREAD

(75) Inventor: Roger Milner King, Buckinghamshire (GB)

(73) Assignee: Beeson & Sons Limited (GB)

( * ) Notice: Subject to any disclaimer, the term of this patent is extended or adjusted under 35 U.S.C. 154(b) by 580 days.

(21) Appl. No.: 11/573,862

(22) PCT Filed: Aug. 22, 2005

(86) PCT No.: PCT/GB2005/003270

§ 371 (c)(1), (2), (4) Date: Jun. 26, 2007

(87) PCT Pub. No.: WO2006/018660

PCT Pub. Date: Feb. 23, 2006

(65) Prior Publication Data

US 2008/0017642 A1 Jan. 24, 2008

(30) Foreign Application Priority Data

Aug. 20, 2004 (GB) ..... 0418662.3

(51) Int. Cl.
*B65D 41/36* (2006.01)

(52) U.S. Cl. ..... 220/296; 220/300; 215/331; 215/330

(58) Field of Classification Search ..... 220/265, 220/266, 268, 276, 288, 304, 289, 203.13, 220/787, 789, 799, 800, 801, 307, 293, 296; 215/44, 307, 329, 330, 331

See application file for complete search history.

(56) References Cited

U.S. PATENT DOCUMENTS

| | | | | | |
|---|---|---|---|---|---|
| 2,117,407 | A | * | 5/1938 | Davis | 220/288 |
| 3,139,210 | A | * | 6/1964 | Hein | 220/289 |
| 3,944,104 | A | * | 3/1976 | Watson et al. | 215/307 |
| 4,265,363 | A | * | 5/1981 | Conn | 215/229 |
| 4,537,320 | A | * | 8/1985 | Nielsen | 215/276 |
| 4,671,421 | A | * | 6/1987 | Reiber et al. | 215/228 |
| 4,690,670 | A | * | 9/1987 | Nielsen | 494/16 |
| 5,529,201 | A | | 6/1996 | Tallent et al. | |
| 6,142,186 | A | * | 11/2000 | Donovan | 138/89 |

(Continued)

FOREIGN PATENT DOCUMENTS

DE 19924827 A1 10/2000

(Continued)

OTHER PUBLICATIONS

U.K. Patent Office Search Report dated Jan. 19, 2005 for GB0418662.3.

(Continued)

*Primary Examiner* — Jacob K Ackun
*Assistant Examiner* — Kareen Rush
(74) *Attorney, Agent, or Firm* — Stephen B. Salai, Esq.; Brian B. Shaw, Esq.; Harter Secrest & Emery LLP

(57) ABSTRACT

A container neck and closure assembly, wherein the container neck (10) comprises a first screw thread (14) on an internal surface thereof and the closure (12) comprises a cylindrical plug (32) for insertion into the container neck, said plug having a second screw thread (36, 37) on an outer surface thereof for engagement with the first screw thread to secure and resecure the closure on the neck.

27 Claims, 5 Drawing Sheets

U.S. PATENT DOCUMENTS

| | | | | |
|---|---|---|---|---|
| 6,745,919 | B2 * | 6/2004 | Moros et al. | 222/213 |
| 6,766,922 | B2 * | 7/2004 | da Silva | 222/211 |
| 7,055,710 | B2 * | 6/2006 | King | 215/344 |
| 7,575,121 | B2 * | 8/2009 | Ooka et al. | 215/344 |
| 2002/0134747 | A1 * | 9/2002 | Babcock et al. | 215/252 |
| 2004/0094501 | A1 * | 5/2004 | Miege et al. | 215/252 |
| 2005/0029217 | A1 * | 2/2005 | Dai | 215/252 |
| 2005/0252878 | A1 * | 11/2005 | Babcock | 215/252 |
| 2006/0138071 | A1 * | 6/2006 | Tsutsumi et al. | 215/252 |
| 2006/0255002 | A1 * | 11/2006 | Takamatsu et al. | 215/252 |

FOREIGN PATENT DOCUMENTS

| | | | |
|---|---|---|---|
| GB | 2267693 | A | 12/1993 |
| GB | 2306162 | A | 4/1997 |
| GB | 2382071 | A | 5/2003 |
| WO | WO 95/05322 | A1 | 2/1995 |
| WO | 98/31598 | A1 | 7/1998 |
| WO | WO 02/42171 | A1 | 5/2002 |
| WO | WO 03/045805 | A | 5/2003 |
| WO | 03/045805 | A1 | 6/2003 |

OTHER PUBLICATIONS

International Search Report dated Feb. 9, 2006 for PCT/GB2005/003270.

English translation of Japanese Examination Report dated Mar. 9, 2011 (4 pages).

JP 2003-221050—Publication date: Aug. 5, 2003, includes partial English translation of Laid-Open Publication (10 pages).

JP 2002-80050—Publication Date: Mar. 19, 2002, includes partial English translation of Laid-Open Publication (8 pages).

JP 38-14892—includes partial English translation of Laid-Open Publication (8 pages).

* cited by examiner

CONTAINER CLOSURE ASSEMBLY WITH INTERNAL NECK THREAD

The present invention relates to a container closure assembly having an internal thread on the container neck. The invention also relates to containers provided with such closure assemblies.

Current commercially mass-produced containers use threads on the outer surface of the container neck that engage with complementary threads on the inner surface of a skirt of the closure. The threads usually comprise a single, substantially continuous thread portion on the container neck with a low thread-pitch angle, typically less than 5°. The low pitch angle is needed in order to ensure that the closure does not unscrew spontaneously. The low pitch angle also provides the necessary leverage to achieve an air-tight compressive seal between the closure and the container neck when the closure is tightened onto the container neck. The low pitch of the helical threads also means that the closure typically needs to be rotated through more than 360° to disengage it completely from the container neck.

Drawbacks of these low-pitch helical threads include the laborious rotation required to remove and resecure the closure on the neck, excessive use of molding material to form the long helical threads, and unreliable separation of tamper-evident rings from the closure skirt due to the low pitch angle of the threads.

The present applicant has described an improved pressure safety closure for carbonated beverage containers in International Patent application W095/05322. This application describes container closure assemblies having substantially continuous threads defining a substantially continuous helical thread path, although the pitch of the helix can vary. The closure can be moved from a fully disengaged to a fully secured position on the container neck by rotation through 360° or less. The threads on the neck or the closure are provided with mutually engageable elements to block or restrict rotation of the closure in an unscrewing direction beyond an intermediate position when the closure is under an axial pressure in a direction emerging from the container neck, the neck and closure being constructed and arranged to provide a vent for venting gas from the container neck at least when the closure is in the intermediate position. This pressure safety feature prevents the closure from blowing off uncontrollably once unscrewing of the closure from the container neck has started. It thus allows the use of shorter, more steeply pitched or multiple-start threads in the container and closure assembly, thereby rendering the assembly much more elderly- and child-friendly without sacrificing pressure safety. WO97/21602 and WO99/19228 describe improved versions of the assemblies of WO95/05322.

The beverage container closure assemblies exemplified in WO95/05322 have short projecting thread segments on the cap and longer projecting thread segments on the container neck. This arrangement is conventional, in part because of the requirements of high-speed injection moulding of the caps, according to which the caps must be "bumped" off a (preferably) one-piece mold mandrel with minimum distortion.

Interestingly, the various screw-top formats for beverage containers have not yet completely replaced glass bottles with crown closures. This is despite the fact that crown closures require a bottle opener to open, and cannot be resecured on the bottle neck in airtight fashion, thereby making it necessary to consume the whole contents of such a bottle immediately after opening.

The present applicant considers that one of the reasons for the continued use of crown closures is that they are better suited for consumption directly from the bottle because the relatively smooth surfaces of the bottle neck are more comfortable between the consumer's lips. This characteristic will be referred to as the "user-friendliness" of the bottle neck. In contrast, screw top container necks have neck threads that present a relatively rough or abrasive surface to the lips.

Accordingly, in WO03/045806 the present applicant has described a threaded container closure assembly wherein the screw thread on the neck is made up of short thread segments, and the screw thread on an inner surface of the skirt of the closure is made up of relatively long screw thread segments. The use of relatively short thread segments on the neck increases the user-friendliness of the neck.

It is also known to provide closure assemblies comprising a neck and a closure having a base and a plug portion for insertion into the neck, wherein threads are provided on an inside surface of the neck for engagement with complementary threads on the outside of the closure plug. For example, GB-A-2267693 describes a vacuum flask for storing hot beverages having such a thread arrangement. The threads are continuous, low-pitch threads, and the closure must be secured and resecured by multiple rotations on the neck.

It is an object of the present invention to provide improved screw top closure assemblies for containers. The present invention is especially applicable to (but not limited to) beverage containers, including carbonated beverage containers.

In a first aspect, the present invention provides a container neck and closure assembly, wherein the container neck comprises a first screw thread on an internal surface thereof and the closure comprises a cylindrical plug for insertion into the container neck, said plug having a second screw thread on an outer surface thereof for engagement with the first screw thread to secure and resecure the closure on the neck.

The container closure assembly according to the present invention comprises thread arrangements that are quick and easy to secure and resecure. Preferably, the closure can be secured and resecured on the container neck by a single smooth rotation through about 360° or less, more preferably 180° or less, still more preferably about 90° to about 120°, most preferably about 90°.

The first screw thread is provided on an internal surface of the neck, that is to say it projects inwardly from the inside surface of the neck. The provision of the thread internally on the container neck allows the outer surface of the container neck to be made substantially smooth in order to maximize its user-friendliness and aesthetic appeal. The provision of the thread externally on the cylindrical plug of the closure makes the closure especially easy to manufacture by high-speed moulding, because the closure can simply be bumped off the mould mandrel without damaging the thread.

The mean inside diameter of the neck may be typical for carbonated beverage containers, for example about 1.5 to about 3 cm. In other embodiments the neck has a larger diameter to assist drinking or pouring from the neck, for example a mean inside diameter of from about 3 to about 8 cm, preferably from about 4 to about 6 cm. In yet other embodiments, the assembly may be suitable for a wide-mouth drinking vessel having an opening with an inside diameter of up to 12 cm, for example from about 5 cm to about 10 cm. The wall thickness of the container neck (excluding the threads) is preferably conventional, for example from about 1 mm to about 5 mm, preferably from about 2 mm to about 4 mm.

The outer surface of the container neck is preferably substantially smooth, but may comprise a projecting circumferential bead proximate to the lip of the container neck, similar to that found on glass bottles suitable for closure with a crown cap. Suitably, the lip of the container neck comprises is fully radiused (rounded). The outer surface of the container neck may comprise a projecting circumferential lip below the lip of the container neck for retaining a tamper-evident ring.

Preferably, the first thread is formed integrally with the container neck by moulding of a thermoplastic material. That is to say, the first thread is not formed on a liner or bushing that is inserted into the neck, but is moulded in one piece with the neck from the same material as the neck in a single moulding operation. The thermoplastic material may preferably be a relatively rigid thermoplastic material such as a polyester, a polyamide or polystyrene. A preferred material for the container neck is polyethylene terephthalate (PET).

The use of short thread segments on the first thread can enable the moulding of the neck including the first threads to be carried out using a relatively simple, separable mould mandrel. Alternatively, the neck and the neck thread may be molded using the two-stage method described in WO97/19806, the entire content of which is incorporated herein by reference. In this method, a precursor of the neck thread is initially formed on an upper surface of a flange of an injection-molded container perform. The perform is then blow molded to form the container by a special process whereby the said flange is drawn down and forced outwardly to form the container neck, such that the said upper surface forms the inner surface of the neck.

Preferably, the first and second threads are continuous helical threads. That is to say, they are not bayonet-type threads that require a stepped motion of the closure to secure the closure on the neck, but rather they follow a substantially continuous helical thread path having a thread gradient less than 90 degrees substantially throughout. Preferably the thread path has a mean thread pitch of from about 5° to about 25°, more preferably from about 10° to about 20°. Suitably, the total axial displacement of the closure relative to the neck between initial engagement of the threads and the fully secured position of the closure on the neck is from about 4 mm to about 1 cm, for example from about 5 mm to about 8 mm.

Preferably, there are at least two of said first thread segments. More preferably, there are at least four of said first thread segments. In the larger neck formats especially there may be six, eight, ten, twelve or more of the first thread segments. The number of second thread segments is typically the same as the number of first thread segments. Preferably, this results in a number of thread starts equal to the number of first thread segments. That is to say, preferably at least two thread starts, more preferably at least four, such as six or eight thread starts. This further assists securing of the closure on the neck, since the user needs to rotate the cap less in order to find a thread start. Preferably, the threads are substantially free-running or parallel threads. That is to say, the threads on the closure and cap slide past each other freely without forming an interference fit between the thread segments on the closure and cap.

The first thread segments on the inside of the container neck are preferably shorter than the second thread segments. That is to say, they preferably extend radially around the inside of the container neck by a smaller angle than the angle through which the second thread segments extend around the cylindrical plug. Usually, the first thread segments do not extend all the way around the neck. Preferably, for ease of moulding as described above, they do not circumferentially overlap around the container neck. Preferably, at least one of the first thread segments extends circumferentially from about 1 to about 60 degrees around the container neck, more preferably from about 2 to about 45 degrees, more preferably from about 5 to about 30 degrees, more preferably from about 10 to about 20 degrees, and more preferably all of the first thread segments so extend. Preferably, the maximum length of each first thread segment is from about 2 to about 20 mm, more preferably from about 4 to about 15 mm, more preferably from about 6 to about 12 mm.

Preferably, all of the first thread segments have substantially the same shape and configuration, whereby the number of thread starts may be equal to the number of first thread segments.

The term "first thread segment" typically refers to an elongate, pitched projection on the inside surface of the container neck. However, in certain embodiments it may refer to a simple projecting boss or peg. The upper and lower surfaces of the first thread segments may have different pitches, and the pitch along one or other of said surfaces may also vary. The mean pitch of the upper and lower first thread segment surfaces is preferably from about 5° to about 25°, more preferably from about 10° to about 20°. Preferably, at least one of said surfaces has at least one constant pitch region extending for at least 5° around the container neck. For example, the first thread segment may be a short helical thread segment having rounded ends, similar to the thread segments on the closure caps described in detail in WO95/05322 or WO97/21602.

The first thread segments may be substantially triangular, rectangular, rounded or chamfered rectangular, or trapezoidal when viewed in cross-section along the longitudinal axis of the neck. Preferably, the maximum radial height of the first thread segments above the inner cylindrical surface of the neck finish is greater than 0.1 mm, more preferably greater than 0.2 mm and still more preferably from 0.5 to 3 mm, most preferably from 1 to 2 mm. Preferably, the width of the first thread segments (measured along the longitudinal axis of the container neck) is from 1 mm to 6 mm, more preferably from 2 mm to 4 mm. The use of such relatively large and high thread segments helps make it possible to produce a neck finish onto which a suitable threaded cap can be secured and resecured in pressure-resistant fashion without the use of lengthy, low-pitch threads as described in the prior art.

As already noted, the second thread segments on the outside of the cylindrical plug usually define a substantially continuous helical thread path along which the first thread segments travel from a substantially fully disengaged to a substantially fully secured position of the closure on the container neck. That is to say, the first and second threads do not engage in a stepped fashion like a bayonet closure (which is normal for short thread segments), but rather in a conventional continuous helical screw fashion. The continuous thread path renders the assembly especially easy to close by the elderly and infirm, or by children. In contrast, bayonet-type threads require a relatively complex, stepped manipulation to secure the closure onto the container neck, with the result that the closure is often inadequately secured on the container neck. Furthermore, it is extremely difficult to devise a tamper-evident ring for the closure that separates reliably and easily upon opening of a bayonet-type closure assembly. Finally, a continuous thread is easier for physically weak people to screw down against pressure from inside the container than a bayonet thread.

In order to achieve the continuous thread path second thread segments preferably extend around the cylindrical plug a sufficient distance so that a top portion of one thread segment is proximate to a bottom portion of another thread segment, and preferably overlaps the other thread segment for a finite angular distance around the cylindrical plug. That is to say, preferably respective top and bottom portions of adjacent second thread segments are circumferentially overlapping. Preferably, at least one of the second thread segments extends for at least 45° around the cylindrical plug, more preferably at least 60° around the cylindrical plug, more preferably at least 90°. A thread gap is defined between the said top and bottom portions of the thread segments. One of the first thread segments travels through this thread gap as the closure is screwed onto or off the container neck.

Preferably, the maximum radial height of the second thread segments above the cylindrical surface of the cylindrical plug is greater than about 0.1 mm, more preferably greater than about 0.2 mm and still more preferably from about 0.5 to about 3 mm, most preferably from about 1 to about 2 mm. Preferably, the width of the second thread segments (measured along the longitudinal axis of the cylindrical plug) is from about 1 mm to about 6 mm, more preferably from about 2 mm to about 4 mm.

The second thread may be a broken or interrupted thread having a plurality of gaps in each thread segment, but the gaps being sufficiently radially narrow not to interfere with the operation of the second thread segments. That is to say, the second thread segments still define a substantially continuous helical thread path therebetween. This requires the gaps in the second thread segments (as well as any circumferential gaps between the second thread segments) to be radially narrower than the first thread segments. The presence of the narrow gaps in the second thread segments may improve gas venting through the second thread when opening pressurized containers.

Preferably, at least one of the second thread segments also has a profiled longitudinal cross section when viewed parallel to the axis of rotation. This second thread cross section is preferably complementary to the longitudinal cross section described above for the first thread segments. It will be appreciated that this can result in a better fit between the first and second thread segments.

The present invention is applicable to a wide variety of containers in which user friendliness is desirable, including containers for both carbonated and non-carbonated beverages. The present invention is applicable to molded thermoplastics container closure assemblies, and also to glass or metal container closure assemblies, and to combinations thereof (e.g. a glass container neck with a metal or thermoplastic closure).

In certain embodiments, the container closure assembly according to the invention is an assembly for a pressurized container, such as (but not limited to) a carbonated beverage container. Preferably, the container further comprises mutually engageable elements on the neck and the closure to block or restrict rotation of the closure in an unscrewing direction beyond an intermediate position when the closure is under axial pressure in a direction emerging from the container neck. This is the so-called pressure safety feature that is intended to prevent the closure unscrewing uncontrollably or missiling as it is removed from the container neck under pressure. Preferred embodiments of this pressure safety feature are as described in W095/05322, WO97/21602 and WO99/19228, the entire contents of which are incorporated herein by reference.

Preferably, the first and second screw threads are constructed and arranged to permit axial displacement of the closure relative to the neck at least when the closure is at the said intermediate position, and preferably the engageable elements are adapted to engage each other when the closure is axially displaced in a direction emerging from the neck, for example by axial pressure from inside the pressurized container. More preferably, the mutually engageable elements are constructed and arranged not to mutually engage each other when the closure is axially displaced in a direction inwardly towards the neck at the intermediate position, for example when the closure is being screwed down onto the container neck.

Preferably, the mutually engageable elements comprise a step or recess formed in the upper surface of one of the second screw thread segments to provide a first abutment surface against which a second abutment surface on one of the first screw thread segments abuts to block or restrict rotation of the closure in an unscrewing direction at the said intermediate position when the closure is under axial pressure in a direction emerging from the container neck.

In these embodiments, the second thread segment may comprise a first thread portion having a first longitudinal cross section and a second thread portion having a second longitudinal cross section narrower than the first cross section, whereby the first thread segment abuts against the second thread portion at the said intermediate position when the closure is under axial pressure in a direction emerging from the container neck. The relatively broad first cross section is preferably adjacent to the circumferentially overlapping region of the second thread segments, resulting in a relatively narrow thread gap in that region.

Preferably, the first and second threads on the container neck and closure are variable pitch threads, for example as described in WO97/21602, the entire contents of which are incorporated herein by reference. Preferably, the pitch of the upper surface of the second thread segments is relatively lower in a first region and relatively higher in a second region displaced from the first region in an unscrewing direction. The pitch of the said upper surface in the first region is preferably substantially constant. The first region normally includes the position against which the first thread segment abuts when the closure is sealed on the container neck. Preferably, the first region extends for 20°-40° about the circumference of the container neck or the closure skirt. Preferably, the pitch of the said upper thread surface in the first region is in the range of 1° to 12°, more preferably 2° to 8°.

Preferably, the second region is adjacent to the first region of the said upper surface of the second thread segments. Preferably, the pitch of the helical thread path in the second region is substantially constant, and the second region preferably extends for 15° to 35° about the circumference of the container neck or the closure skirt. Preferably, the pitch of the said upper thread surface in the second region is in the range of 15° to 35°.

The use of a variable pitch thread renders it easier to combine fast-turn threads having a steep average pitch that are elderly- and child-friendly with pressure safety. A problem that could arise with fast-turn threads is that they are steeply pitched, which results in a tendency to back off from the fully secured position on the container neck when the container is pressurized. This problem can be overcome by using bayonet-type threads, but the use of bayonet-type threads results in a number of different problems, as described above. In contrast, the variable pitch threads solve the problem of backing off of the closure under pressure, whilst retaining all of the advantages of continuous, fast-turn threads.

Preferably, the said upper surface of the second thread segments further comprises a third region adjacent to the second region, wherein the third region has a relatively low pitch. Preferably, the third region has a relatively constant pitch, preferably in the range 1 to 12°, more preferably 2 to 8°. The third region preferably includes the region against which the first thread segments on the container neck abut when the closure is blocked at the intermediate gas venting position.

The relatively low pitch of the third region reduces the tendency of the closure to override the blocking means at high gas venting pressures.

In certain embodiments, the closure assembly includes a recess in outer surface of the threaded cylindrical plug, the recess being located between and circumferentially overlapping two of the plurality of second thread segments to increase the cross-sectional area provided for gas venting between the second thread segments. It has been found that the thread gap between overlapping portions of adjacent second thread segments may have a cross-section that is too small for optimal gas venting in all circumstances. The recess overcomes this difficulty by increasing the cross-section of the thread gap to increase the rate of gas venting through the thread gap.

The increased cross-sectional area of the venting pathway in the circumferentially overlapping regions of the second thread permits faster venting of pressure from inside the container, and thereby reduces the length of time that the closure is blocked at the intermediate position while venting takes place, without any loss of pressure safety.

Preferably, the recess comprises an elongate groove extending around the cylindrical plug between the second thread segments in the said overlapping regions. Preferably, the elongate groove extends substantially parallel to the helical thread path. Preferably, the longitudinal cross-sectional area of the recess is from 5% to 50% of the mean longitudinal cross-sectional area of the second thread segment portions adjacent to the recess.

Preferably, the container neck and the cylindrical plug further comprise complementary locking elements that block or resist unscrewing of the closure from the fully secured position on the container neck until a predetermined minimum opening torque is applied. In certain embodiments, the locking elements comprise a longitudinal locking rib on one of the container neck or the cylindrical plug, and a complementary locking ramp on the other of the container neck and the cylindrical plug, said locking rib abutting against the retaining edge of the locking ramp when the closure is fully secured on the container neck. Preferably, the complementary locking elements are provided on the same surfaces as the threads, that is to say on the internal surface of the container neck and the outside surface of the cylindrical plug of the closure.

The locking arrangement helps to prevent the closure from backing off under pressure from inside the container. It also provides a positive click that indicates to the user when the closure has been screwed onto the neck sufficiently to achieve a pressure-tight seal.

Accordingly, at least one, and preferably both of the complementary locking projections on the neck and/or the closure is substantially separate from the thread segments and can flex substantially independently of the thread segments in order to provide the snap-fitting and clearly audible click as the fully secured position of the closure on the neck is reached. In general, a radially innermost vertex of the second locking element on the neck rides over a radially outermost vertex of the first locking element on the cylindrical plug as the fully secured position is approached. The second locking element then rides back over the first locking element when the closure is removed from the secured position, for example when opening the assembly.

At least one, and preferably both of the complementary locking projections on the neck and/or the closure has a length in the longitudinal direction (i.e. along the rotational axis of the closure assembly) of from about 1 mm to about 6 mm, for example from about 2 mm to about 4 mm. At least one, and preferably both of the complementary locking projections on the neck and/or the closure has a height of from about 0.25 mm to about 2 mm, for example from about 0.5 mm to about 1.5 mm. In any case the height of the locking projections is normally less than the average height of the respective thread segments. At least one, and preferably both of the complementary locking projections on the neck and/or the closure has a maximum width (i.e. around the circumference of the neck or closure skirt) of from about 0.5 mm to about 3 mm, for example from about 1 mm to about 2 mm. At least one, and preferably both of the complementary locking projections on the neck and/or the closure has a ratio of the maximum height to the maximum width of at least about 0.5, more preferably at least 1, for example from about 1 to about 5.

In certain embodiments, the first and second locking projections longitudinally overlap the first or the second thread segments when the closure is in the fully engaged position on the container neck. In other words, in these embodiments the first and second locking projections (also referred to herein as side catches) are not located entirely above or below the threads (the terms above and below refer to relative positions along the longitudinal axis of the assembly), but are located, at least in part, radially in-between the threads. The side catches are preferably located adjacent to an end of the threads. This enables the entire thread assembly to be made more compact in the longitudinal (vertical) direction, thereby reducing the total amount of moulding material needed to make the assembly, and the space taken up by the assembly.

Typically, the first and second locking elements are situated near the lower end of the threads when the closure is fully secured on the container. Preferably, the first and/or second locking elements do not extend below the lower edge of the first or second thread segments when the closure is in said fully engaged position on the container neck. In such assemblies, the locking projections are preferably located substantially completely radially between the thread segments and not above or below the threads.

In suitable embodiments of this type, the second locking projection is located longitudinally overlapping with and radially spaced from a lower end of a second thread segment. The circumferential spacing between the projections and the respective thread segments in these embodiments is typically from about 1 mm to about 10 mm, for example from about 1 mm to about 4 mm. In these embodiments, the radially spaced locking projections may guide the thread segments of the other assembly component as the assembly is screwed together. That is to say, the radially spaced projections may define a part of the thread path on the closure or neck. For example, in the case where there are relatively long thread second segments on the cylindrical plug defining a thread path for relatively short thread segments on the container neck, the locking projections on the closure skirt may be radially spaced from the lower end of the relatively long thread segments on the closure skirt and may thereby define an extension at the start of the thread path followed by the thread segments on the neck when the closure is applied to the neck. This method of using the locking projections to form an extension of the thread path on one of the neck or the closure solves the problem of providing larger locking projections that overlap with the threads, but do not interfere with the running of the threads. The locking projections are generally in the line of and, as it were, are extensions of the thread path on one of the neck or the closure.

The assemblies according to the present invention may comprise more than one pair of complementary locking projections on the container neck and the closure. Preferably there are at least two such complementary pairs radially spaced around the neck and the cylindrical plug. There will normally be at least one pair for each thread start, for example there may be four pairs radially spaced around the neck and cylindrical plug.

Preferably, the locking projections on the neck and the cylindrical plug are radially positioned such that they are in abutment when the closure is at the fully closed and sealing position on the container neck. That is to say, the projection on the cylindrical plug has ridden over one side of, and is resting in abutment with the opposite side of, the corresponding projection on the container neck at said fully closed and sealing position. This ensures that there is no play in the cap at said closed and sealing position that could allow leakage from the seal. Preferably, when the projections are in abutment at the closed and sealing position, the cylindrical plug and/or the projections are still slightly distorted such that a resilient force is exerted between the projections in abutment. This resilient force is leveraged by the abutment into a closing torque between the closure and the neck that urges the closure into the fully closed and sealing position. This can ensure that the respective sealing surfaces of the container neck and the closure are automatically seated against each other, even though the closure may not be screwed down especially tightly. Furthermore, the locking projections allow for considerably lower manufacturing tolerances in the moulding of the assembly, since effective sealing is achieved over a broader range of radial sealing positions due to the interaction between the locking projections and the radial deformation of the closure skirt.

The advantages of such locking projections that urge the closure into the sealing position are discussed in detail in WO93/01098, the entire content of which is incorporated herein by reference.

The complementary locking elements according to the present invention provide a number of other important advantages, besides urging the closure into the fully secured and sealing position as described above. Firstly, they prevent accidental backing off of the closure from the fully engaged and sealing position on the container neck due to pressure from inside the container. These elements enable more steeply pitched threads and free running (parallel) threads to be used without risk of the closure unscrewing spontaneously. The use of more steeply pitched threads in turn makes it easier to remove and resecure the closure. This system can also ensure that exactly the right degree of compression is applied between respective sealing surfaces on the container and closure to achieve an effective airtight seal when the closure is on the fully secured position on the neck.

The container closure assembly according to the present invention may further comprise a projecting stop surface on one of the container neck and the closure for abutment against a second stop or a thread segment on the other of the container neck or the closure to block over-tightening of the closure beyond a predetermined angular sealing position of the closure on the container neck. The stop means acts in conjunction with the locking arrangement to ensure that exactly the right degree of screwing of the closure is achieved in order to provide a pressure-tight seal with the sealing arrangement of the present invention. Preferably, the complementary stop means are provided on the internal surface of the container neck and the outside surface of the cylindrical plug.

Suitable locking and stop arrangements for use with assemblies according to the present invention are described in detail in WO 91/18799 and WO 95/05322, the active contents of which are expressly incorporated herein by reference.

The assemblies according to the invention preferably comprise sealing elements on the container neck and/or on the closure for sealing the container when the closure is secured on the container neck. The sealing elements may comprise a sealing liner, for example a liner of elastomeric material, inside the base of the closure cap. The liner is pressed against the lip of the container neck to form the seal. However, the sealing elements preferably comprise one or more circumferential sealing projections on the container neck and/or the inside of the closure. Preferably, the sealing projections are provided only on the closure, so that the surface of the neck remains smooth to enhance its user-friendliness. The sealing projections may comprise a circumferential sealing skirt and/or one or more circumferential sealing ribs and/or sealing fins for sealing against the lip or the inside or outside surface of the container neck.

In certain embodiments, a cylindrical sealing plug extends from the base portion of the closure inside the container neck for sealing engagement against an inside surface of the neck proximate to the lip and above the first thread segments. The cylindrical sealing plug may comprise at least one circumferential sealing rib on an outer surface of said sealing plug for engagement with the inner surface of the container neck proximate to the lip when the closure is secured on the container neck. The sealing means may alternatively or additionally comprise at least one flexible sealing fin extending from the base of the closure for engagement with the lip of the container when the closure is secured on the container neck. The sealing means may alternatively or additionally comprise a circumferential sealing skirt extending around the closure for engagement with the lip or the outside surface of the container neck. In these embodiments, at least one circumferential sealing rib may further be provided on the skirt for engagement with the outer surface of the container neck when the closure is secured on the container neck.

Where present, at least one of the sealing ribs suitably has a substantially triangular cross-section, for example substantially equilateral triangular. This enables the sealing force to be concentrated in the tip of the sealing rib to maximize sealing effectiveness. Suitably, at least one of the sealing ribs has a height in the range of 10 to 500 micrometers, more preferably 50 to 250 micrometers. Such micro sealing ribs are especially effective to concentrate the sealing force and achieve an effective seal with a substantially smooth sealing surface on the container neck. Furthermore, such micro ribs are especially easy to mould in high-speed cap moulding equipment, and to bump off the mould mandrel of the equipment after moulding. Preferably, two circumferential sealing ribs are located in facing relationship at substantially the same height above the base of the closure so that, in use the closure applies the sealing ribs symmetrically on either side of the container lip to apply a symmetrical sealing pinch.

The sealing fins may have their base in the base of the closure between the skirt and the sealing plug, or they may extend inwardly or outwardly and downwardly from the base of the skirt or the sealing plug. Preferably, at least one of the sealing fins extends in a direction downwardly and outwardly from the base of the closure between the sealing plug and the closure skirt. Preferably, the closure comprises two or four sealing fins extending around the closure in concentric fashion. Preferably, two sealing fins are disposed substantially symmetrically on either side of the container lip to provide a balanced sealing pinch on the lip.

Preferably, the container closure assembly comprises a second sealing fin extending downwardly and inwardly from the base of the closure between the sealing plug and the closure skirt. The first and second sealing fins then seal against opposite sides of the container lip, preferably in substantially symmetrical and balanced fashion. The first and second sealing fins flex in opposite directions as the closure is secured onto the container neck. This dual action ensures that at least one, and usually both, of the sealing fins makes a pressure-tight seal against the lip.

Preferably, the height of the sealing fins is greater than their width at their base. Preferably, the cross-section of the sealing fins is substantially in the shape of an isosceles triangle. Preferably, at least one sealing fin has a height of from 1 to 4 mm.

The sealing fins alone may lack sufficient resilience to form a secure pressure-tight seal against the top of the container lip. Therefore preferably at least one stop surface is provided proximate to the base of the closure, positioned and arranged such that at least one sealing fin abuts against the stop surface when the closure is secured on the container neck. Preferably, two flexible fins are provided for sealing on either side of the container lip, as described above, and two stop surfaces are provided at the bases of the sealing plug and the closure skirt for abutment against each of the sealing fins at the fully secured and pressure-tight position.

Sealing arrangements of this type incorporating symmetrically disposed sealing ribs and fins are described in more detail in WO02/42171, the entire content of which is incorporated herein by reference.

In certain embodiments, the cylindrical plug on the closure may form an interference sealing fit with the inside of the container neck below the threads when the closure is fully secured on the container neck. The lowermost part of the cylindrical plug below the threads may be inwardly tapered to assist the formation of the interference seal, and the internal surface of the neck may have a complementary taper. This feature helps to reduce contamination of the threads by the contents of the container during transport and storage, as well as giving improved sealing of the container.

Preferably, the torque required to secure the closure in a sealing position on the container neck is less than 1.2 Nm, more preferably less than 1 Nm and most preferably from about 0.7 to about 0.9 Nm. This is the torque required to engage the complementary locking arrangement (where present) at the sealing position, or otherwise the force required to substantially eliminate gas leakage at normal carbonated beverage pressure differentials.

The container closure assembly may also comprises a tamper-evident safety feature. This may consist of a tamper-evident ring that is initially formed integrally with a skirt of the container closure and joined thereto by frangible bridges. A circumferential retaining lip for the tamper-evident ring is provided on the container neck. The tamper-evident ring may comprise a plurality of integrally formed, flexible, radially inwardly pointing retaining tabs as described and claimed in our International Patent Application WO94/11267, the entire contents of which are expressly incorporated herein by reference. Ratchet projections may also be provided on the container neck below the circumferential retaining lip and radially spaced around the container neck to block rotation of the tamper-evident ring on the container neck in an unscrewing direction. However, it may be preferred to smooth or omit the ratchet projections in order to improve user-friendliness of the neck finish.

In certain embodiments the closure cap may comprise a storage compartment having an opening in the base of the cap. This enables a second component, for example a flavour concentrate or a snack food, to be stored in the cap for simultaneous, sequential or combined use with the contents of the container. The storage compartment may for example be formed by providing the closure with a threaded cylindrical plug as hereinbefore described which is hollow and closed at the bottom, with an opening through the base of the closure opposite the plug. The opening may for example be sealed by a membrane that can be peeled off to release the contents of the compartment in the cap.

In a second aspect, the present invention provides a container having a container body and a neck sealed by a container closure assembly according to the invention as hereinbefore described. The container may contain a liquid, such as a beverage. Suitably, the liquid is a carbonated beverage, and the container closure assembly seals and reseals the container in pressure-tight fashion. The container body may for example have a capacity of from about 250 ml to about 5 liters, typically from about 0.5 liters to about 2.5 liters. Suitably, the container neck projects from the container body by at least about 1 cm, for example from about 2 cm to about 4 cm, and the container neck has a substantially smooth outer surface for optimum user friendliness.

The invention has been described above primarily in relation to the preferred embodiments having relatively short thread segments on the container neck and relatively long thread segments on the cylindrical plug of the closure. However, the alternative embodiments having details as described above, but with the relatively short first thread segments on the cylindrical plug of the closure and relatively long second thread segments on the container neck and other features adapted accordingly are encompassed within the scope of the present invention.

Specific embodiments of the container closure assemblies according to the present invention will now be described further, by way of example, with reference to the accompanying drawings, in which:—

Figure 6:
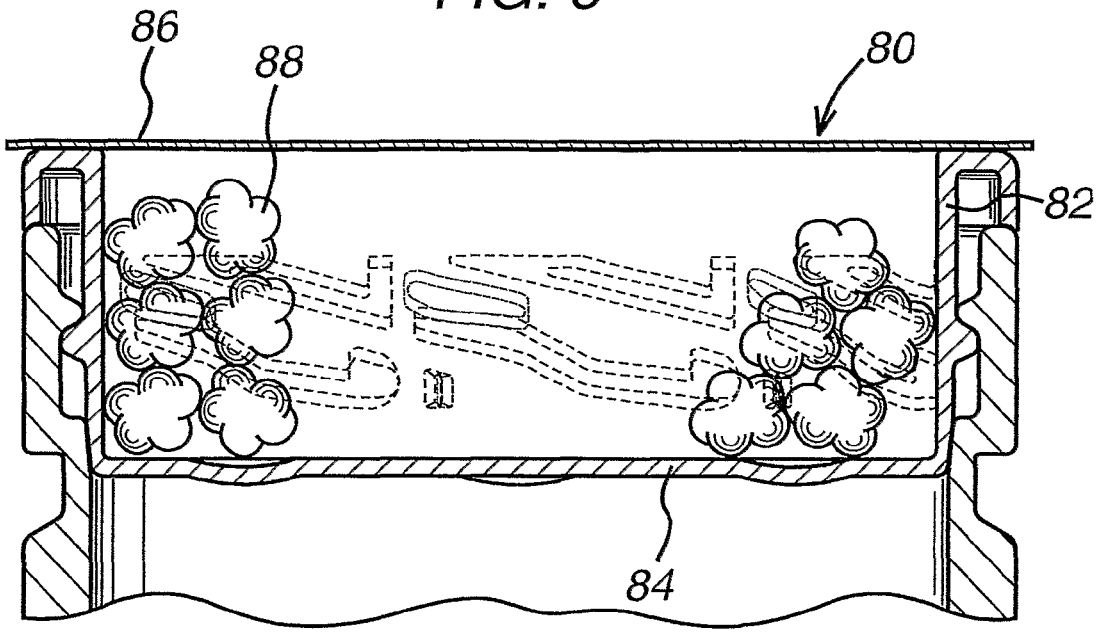
Figure 7:
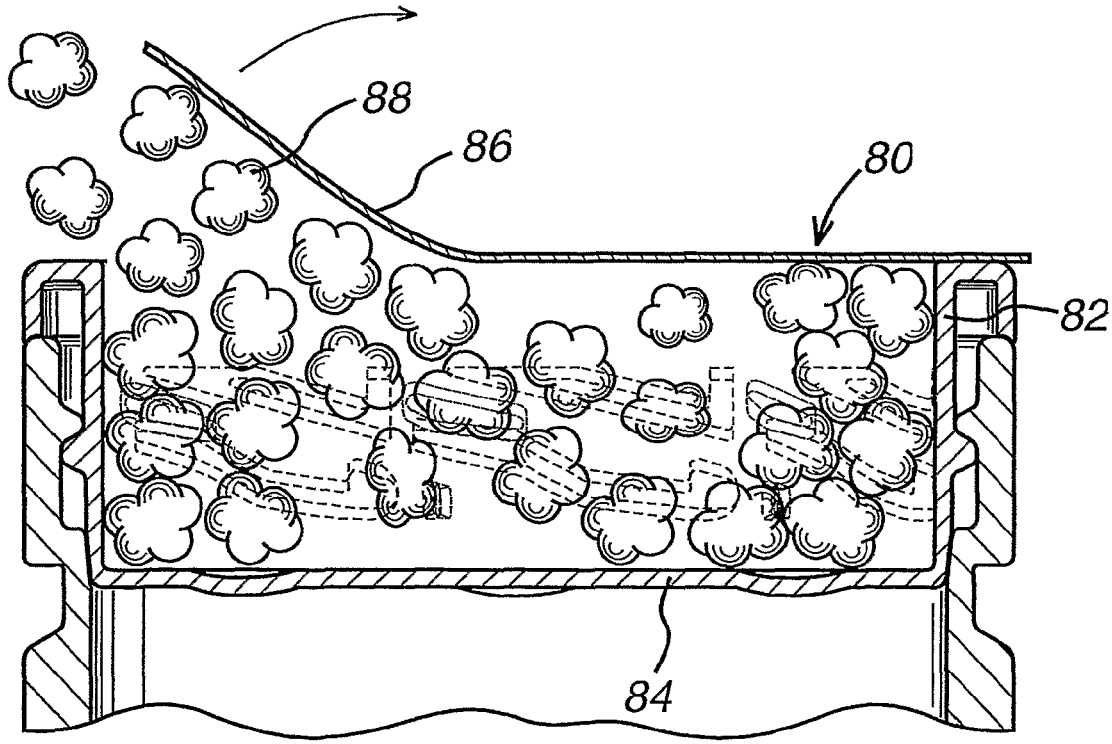

FIG. 6 shows a longitudinal cross section through a fifth embodiment of a container and closure assembly according to the present invention with the closure fully secured on the container neck, wherein the closure includes a compartment for a food or beverage ingredient; and FIG. 7 shows a longitudinal cross section through the embodiment of FIG. 6 with the compartment opened to release the food or beverage ingredient.

Figure 1:
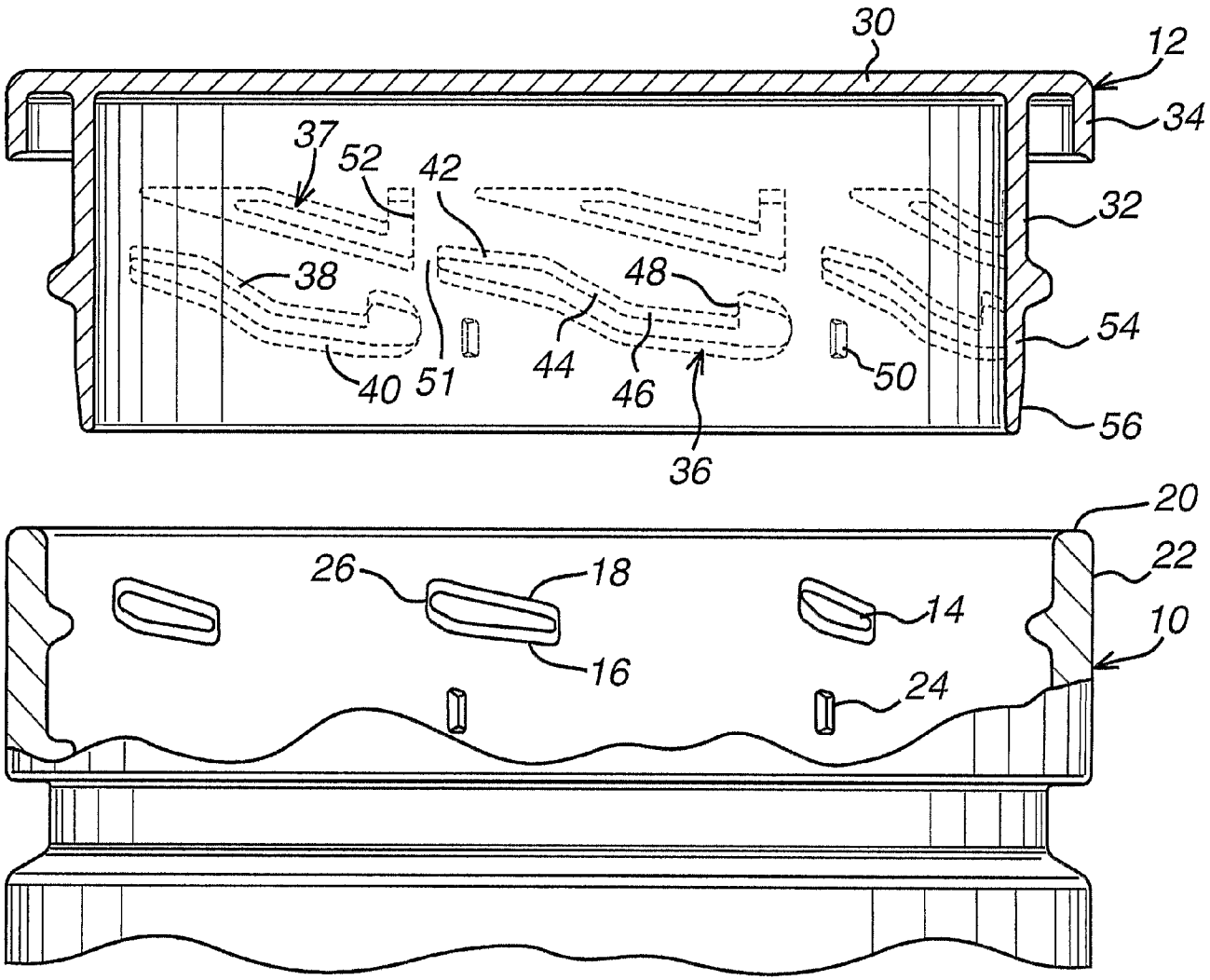
FIG. 1 shows a view of a wide-mouth container and closure according to the present invention with the closure fully removed from the container neck, in which the neck is shown in elevation partially cut away and the closure is shown in longitudinal cross section with hidden threads in broken line.
Figure 2:
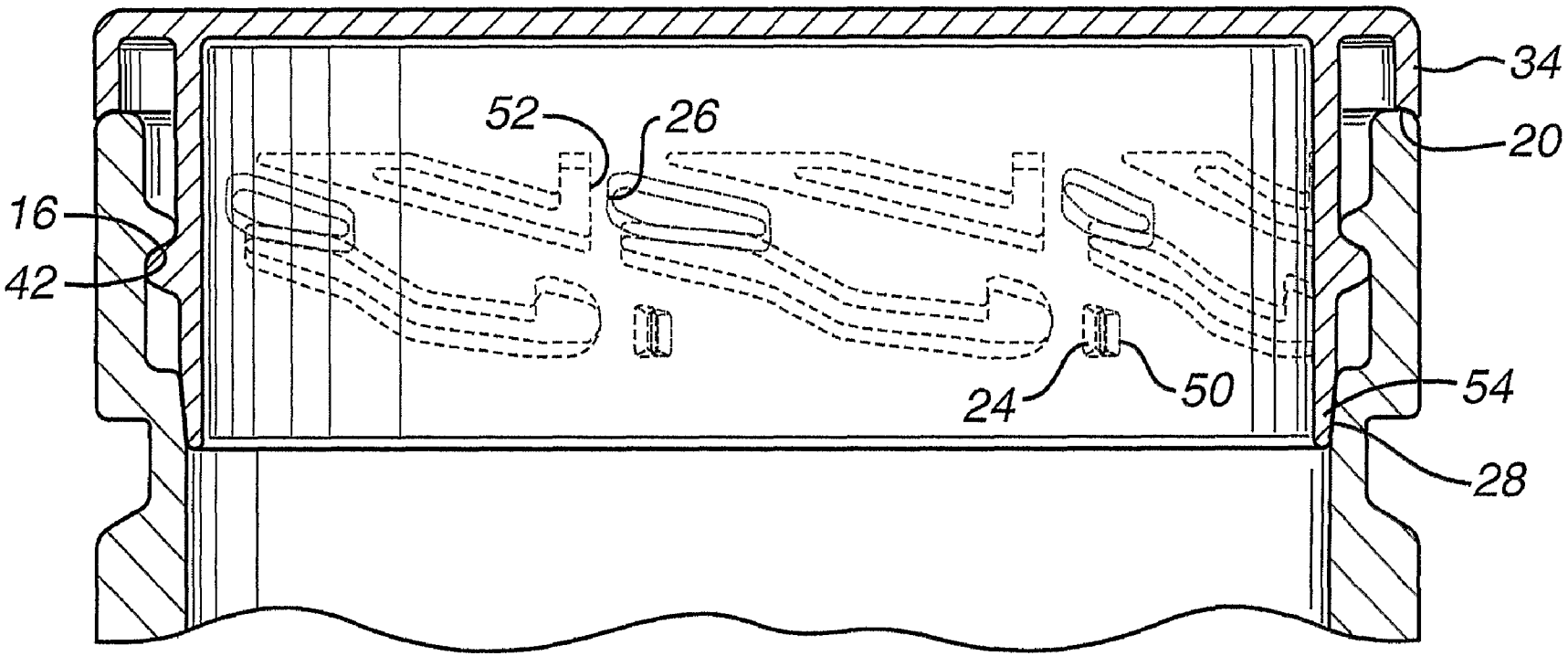
FIG. 2 shows a longitudinal cross section through the assembly of FIG. 1 with the closure fully secured on the container neck.

Referring to FIGS. 1 and 2, this embodiment is a container closure assembly especially adapted for a wide-mouth container, such as a drinking vessel. The assembly includes a container neck 10 of a container for carbonated beverages, and a closure 12. Both the container neck and the closure are formed from plastics material. The container 10 is preferably formed by injection molding and blow molding of polyethylene terephthalate. The closure 12 is preferably formed by injection molding of polypropylene.

The main features of the threads on the container neck and the closure resemble those of the assemblies described and claimed in our International Patent Applications W095/05322 and WO97/21602, WO99/19228, WO03/045805 and WO03/045806, the entire contents of which are incorporated herein by reference. However, it is important to note that the threads on the closure and the neck are reversed in the present invention relative to the closure assemblies described in those applications. That is to say, the earlier patent specifications describe only assemblies having thread segments on the inside of the closure skirt for engagement with thread segments on the outside of the neck, whereas the present invention provides only thread segments on the inside of the neck for engagement with thread segments on the outside of the cylindrical plug.

Referring to FIGS. 1 and 2, The container neck 10 has a rounded lip 20 and a substantially smooth outside surface 22 to enhance the user-friendliness of the neck. The inside surface of the container neck 10 is provided with a six-start first screw thread made up of six first thread segments 14. The first thread segments 14 are short thread segments extending radially about 20° around the neck and having a lower surface 16 with relatively low pitch of about 6° and an upper surface 18 with intermediate pitch of about 13.5°. The first thread segments 14 present a substantially trapezoidal cross-section along the axis of the neck.

The closure 12 comprises a base portion 30, a cylindrical sealing plug 32, and an outer sealing skirt portion 34. The cylindrical plug 32 is provided with a second screw thread formed from six second thread segments. The second thread segments comprise an upper portion 36 and a lower portion 37, separated by a gas venting gap 51. (The term "upper" in this context means closer to the base of the closure, i.e. farther from the open end of the closure). Each portion of the second thread has a lower thread surface 38 and an upper thread surface 40. The upper and lower second thread surfaces 40,38 are profiled so as to give the second thread portions 36,37 a substantially trapezoidal longitudinal cross section that is complementary to the cross-sectional shape of the first thread segments 14. A thread stop 52 projects upwardly from the lower second thread portion 37 adjacent to the gas venting gap 51 in order to prevent over-tightening of the closure on the neck, as described farther below.

A substantially continuous, approximately helical thread gap is defined between overlapping regions of the said upper and lower second thread portions 36,37. It can be seen that the upper and lower portions 36,37 of adjacent second thread segments are circumferentially overlapping over part of their length.

An important feature of this assembly is the non-uniform pitch of the upper surfaces 38 of the lower second thread portions 36, which is described in more detail in our International patent application WO97/21602. The upper thread surfaces 38 in a first, upper region 42 have a substantially constant pitch of only about 6°. The upper region 42 adjoins an intermediate region 44 having a substantially constant, much higher pitch of about 25°. The average pitch of the helical thread path travelled by the first thread segments between the second thread segments is 13.5°.

The threads on the container neck and the cylindrical closure plug also include a pressure safety feature similar to that described and claimed in our International Patent Application W095/05322. Briefly, the lowermost portion of the second thread segment 36 projects upwardly in a step 48 for abutment against an end of the first thread segments 14 to block unscrewing of the closure 12 from the neck 10 when the said first thread segments 14 are in abutment with the upper surface 38 of the lower second thread portions, i.e. when there is a net force on the closure in an axial direction out of the container neck. A third region 46 of the upper surfaces 38 of the second thread portions 36 adjacent to the step 48 also has a low pitch of about 6°. This low pitch angle in the region 48 helps to minimize the unscrewing force on the closure when it is retained at the intermediate position by axial pressure from inside the container.

The container and closure assembly is also provided with complementary locking elements on the container neck and the closure to block unscrewing of the closure from the fully engaged position on the container neck unless a minimum unscrewing torque is applied. These locking elements comprise six equally radially spaced locking ribs 24 on the inside of the container neck, and eight equally radially spaced retaining ribs 50 on the outside of the cylindrical plug 32 against which the ribs 50 on the closure abut when the closure is fully engaged on the container neck, as shown in FIG. 2. The complementary locking means may be as described in our International Patent Application W091/18799, the entire content of which is hereby expressly incorporated by reference. However, the locking ribs are on the inside of the container neck in the present embodiment, which also helps to improve the user-friendliness of the container neck finish.

The locking projections 50 on the cylindrical plug are located level with, and radially spaced by about 2 mm from, the bottom end of the second thread portions 36 on the cylindrical plug. The locking projections on the cylindrical plug are formed as a continuation of the second thread portions 36, whereby the thread segments 14 on the neck 10 can pass smoothly past the locking projections 50 on the cylindrical plug as the cap is secured on the neck.

Each of the locking projections 24,50 is substantially in the form of a triangular prism having its long axis aligned with the axis of the closure assembly. The height of each locking projection is about 1.5 mm, and the base width is about 1.5 mm. This ensures that the projections have sufficient strength to snap over each other without permanent deformation.

The cylindrical plug 32 on the closure 12 extends below the second threads to form a cylindrical sealing plug 54 having a tapered outer surface 56 for forming an interference fit in a complementary tapered inside surface 28 of the container neck below the first thread when the closure is fully secured on the neck.

In use, the closure 12 is secured onto the container neck 10 by screwing down in conventional fashion. The closure 12 can be moved from a fully disengaged position to a fully engaged position on the container neck 10 by rotation through about 30°. When the closure is being screwed down, there is normally a net axial force applied by the user on the closure into the container neck, and accordingly the first thread segments 14 abut against and ride along the lower surfaces 40 of the lower projecting portions of the second thread portions 36 on the cylindrical plug. The first thread segments 14 pass through the gap between the locking elements 50 and the lower thread portions 36 before riding smoothly onto the lower surface of the upper thread portions 37. The first thread segments 14 follow a substantially continuous helical path having an average pitch of about 13.5°.

The threads are free-running, which is to say that there is substantially no frictional torque between the thread segments until the fully engaged position is neared. These features of multiple thread starts, a 30° closure rotation, substantially continuous thread path and free-running threads all make the closure extremely easy to secure on the container neck, especially for elderly or arthritic persons, or children.

As the closure 12 reaches the fully engaged position on the container neck 10, the initial abutment between the container closure plug 56 and the container neck results in a net axial force on the closure in a direction out of the container neck. This pushes the thread segments 14 out of abutment with the lower surfaces 40 of the upper projecting portions 37 of the second thread segments and into abutment with the upper surfaces 38 of the lower projecting portions 36 of the second thread. More specifically, it brings the first thread segments 14 into abutment with the upper regions 42 of the upper thread surfaces 38. Continued rotation of the closure in a screwing-down direction causes the first thread segments 14 to travel along the upper regions 42 until the final, fully engaged position shown in FIG. 2 is reached. The low pitch of the upper regions 42 means that this further rotation applies powerful leverage (camming) to compress the sealing skirt 34 on the closure against the lip 20 of the container neck, and to press the sealing plug 56 into the container neck, in order to achieve an effective seal.

As the closure 12 approaches the fully engaged position on the container neck 10, the locking ribs 50 on the closure ride up and over the locking ribs 24 on the inside of the container neck with an audible click. At the same position, the second ends 26 of the first thread segments 14 may come into abutment with the stop shoulders 52 of the second thread segments, thereby blocking further tightening of the closure than could damage the threads and/or over-compress the sealing skirt 34.

When the closure 12 is in the fully engaged position on the container neck 10, the lower surfaces 16 of the first thread segments 16 abut against the upper regions 42 of the upper thread surfaces 38 of the lower second thread portions 36, as shown in FIG. 2. The lower surface 16 of the first thread segments 14 has a low pitch to match that of the upper regions 42, so as to maximize the contact area between the second thread portions 36 in the regions 42, and thereby distribute the axial force exerted by the closure as evenly as possible around the container neck. Because of the low pitch in the regions 42, relatively little of the axial force emerging from the container neck due to pressure inside the container is converted into unscrewing rotational force by the abutment between the thread surfaces in this position. This greatly reduces the tendency of the closure to unscrew spontaneously under pressure. Spontaneous unscrewing is also prevented by the locking ribs 24,50. A feature of the assembly is that the reduced tendency to unscrew spontaneously due to the low pitch of the thread in the lower regions 42 means that the minimum opening torque of the locking elements 24,50 can be reduced without risk of the closure blowing off spontaneously. This makes the closure easier to remove by elderly or arthritic people, or by children, without reducing the safety of the closure.

Furthermore, when the closure 12 is in the fully engaged position on the container neck 10, the outer surface 56 of the bottom region 54 of the cylindrical plug 32 forms an interference sealing fit against the inner surface 28 of the container neck below the threads. This helps to prevent contamination of the threads by the contents of the container, and also improves the overall sealing efficiency of the assembly.

In use, the closure 12 is removed from the container neck 10 by simple unscrewing. An initial, minimum unscrewing torque is required to overcome the resistance of the locking elements 24,50. Once this resistance has been overcome, essentially no torque needs to be applied by the user to unscrew the closure. The internal pressure inside the container exerts an axial force on the closure in a direction emerging from the mouth of the container, as a result of which the first thread segments 14 ride along the upper surfaces 38 of the projecting lower portions 36 of the second thread as the closure is unscrewed. The first thread segments initially ride along the upper regions 42, and then along the steeply pitched intermediate regions 44 of the upper surface of the second thread segments 36. The first thread segments 14 then come into abutment with the lower projecting stop 48 of the second thread portions 36. In this position, further unscrewing of the closure is blocked while gas venting takes place along the thread paths and through the gas venting gaps 51. It should also be noted that, in this intermediate gas venting position, the lower surfaces 16 of the first thread segments 14 abut primarily against the region 46 of the upper surface of the second thread portions 36. The low pitch of this region 46 results in relatively little of the axial force on the closure being converted into unscrewing rotational torque, thereby reducing the tendency of the closure to override the pressure safety feature and blow off.

When gas venting from inside the container neck is complete so that there is no longer an axial upward force on the closure, the closure can drop down so as to bring the thread segments 14 into abutment with the lower surfaces of the upper portions 37 of the second thread. In this position, unscrewing can be continued to disengage the closure completely from the container neck.

Figure 3:
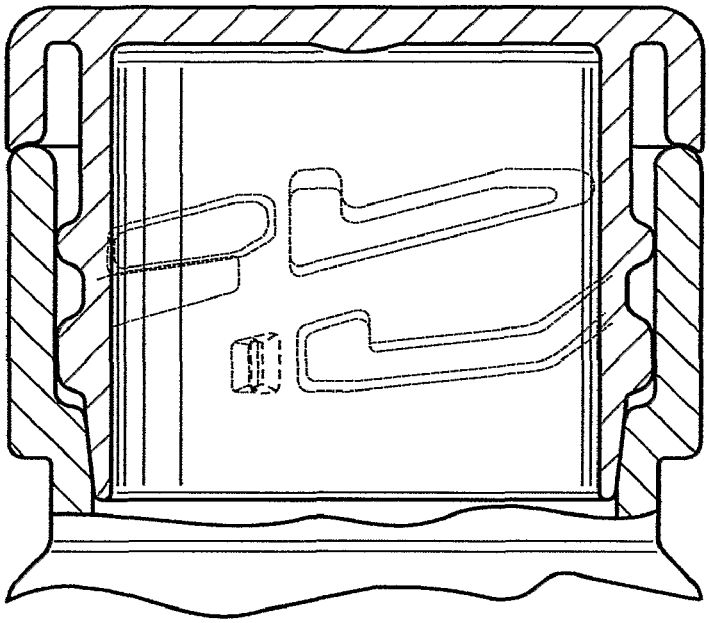
FIG. 3 shows a longitudinal cross section through a second embodiment of a container and closure assembly according to the present invention with the closure fully secured on the container neck.

Referring to FIG. 3, the container and closure assembly may be adapted for a conventional container neck having an internal diameter of from about 1 to about 3 cm. In these embodiments, the construction of the assembly is substantially identical to that described above in relation to FIGS. 1 and 2, but there are only four threads on each of the container and closure and four thread starts, in order to avoid excessive crowding around the neck and the sealing plug.

Figure 4:
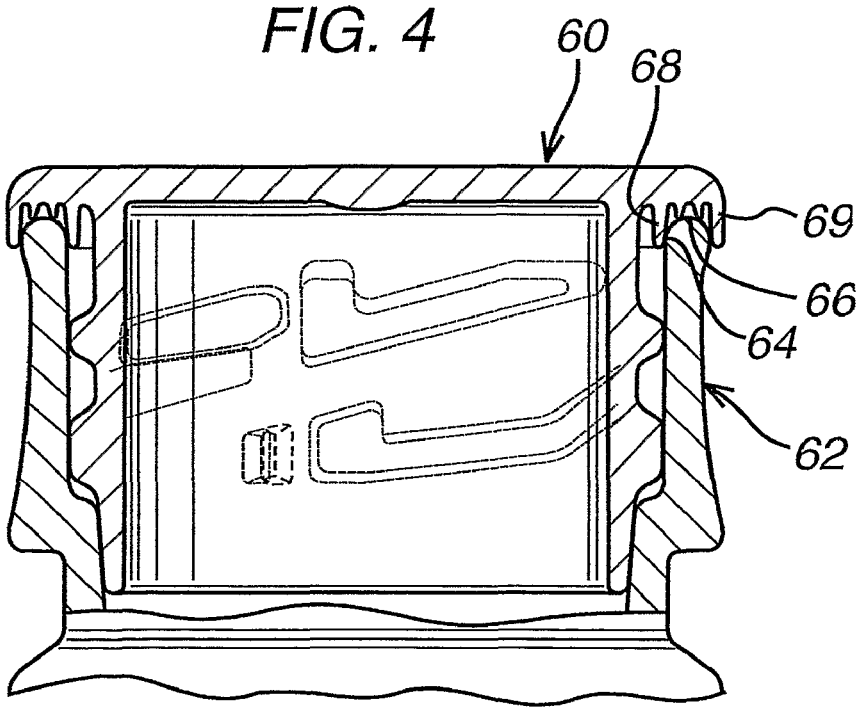
FIG. 4 shows a longitudinal cross section through a third embodiment of a container and closure assembly according to the present invention with the closure fully secured on the container neck.

Referring to FIG. 4, the container and closure assembly according to this embodiment comprises means substantially as described in copending patent application WO02/42171 (the entire content of which is incorporated herein by reference) for forming a gas-tight seal between the closure 60 and the container neck 62 when the closure is fully secured on the neck. The sealing arrangement comprises a sealing plug 68, a sealing skirt 69 and sealing fins for contacting the lip of the container neck. Further information about this sealing arrangement is given below in the detailed description of the embodiment of FIG. 5.

Figure 5:
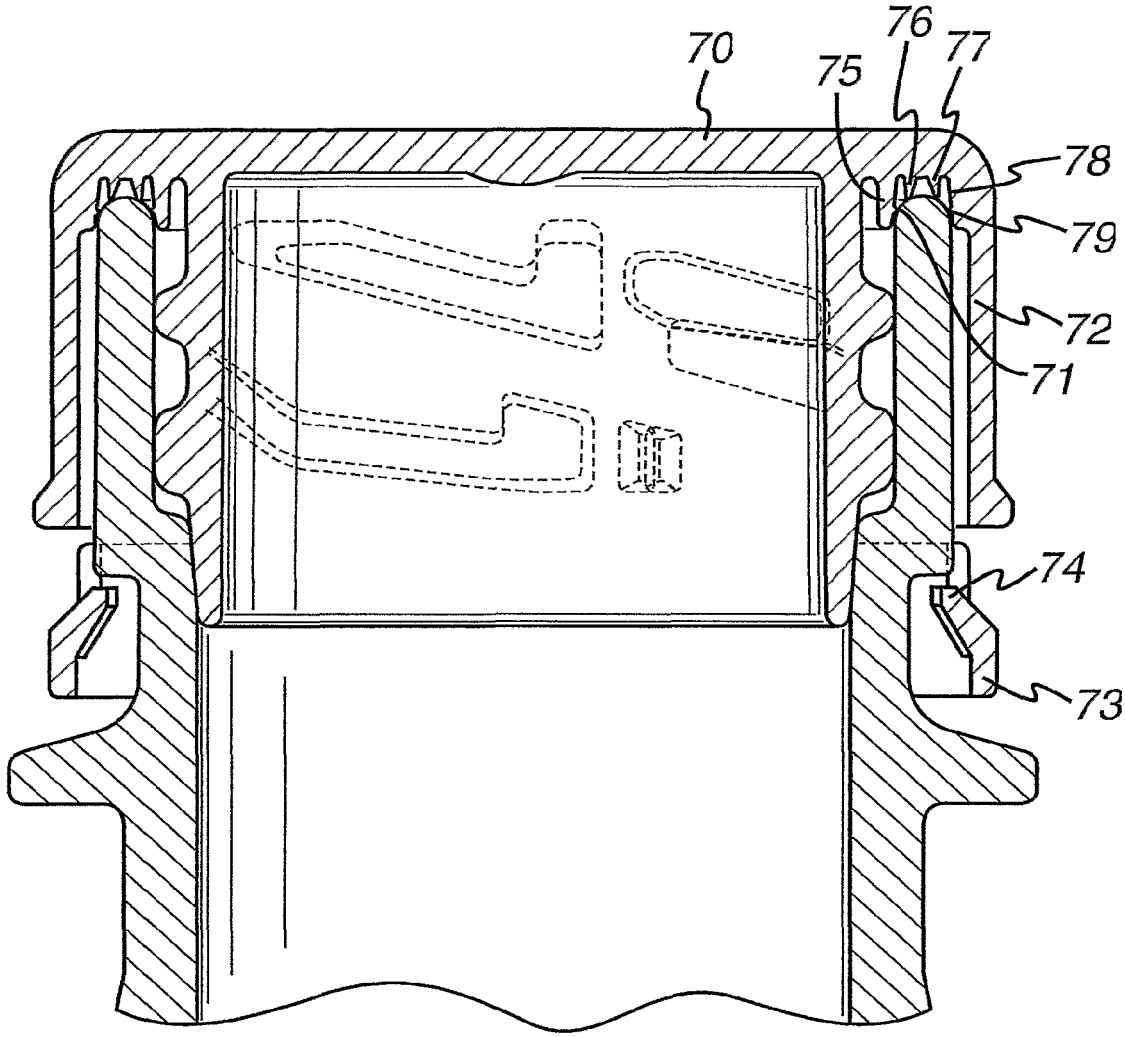
FIG. 5 shows a longitudinal cross section through a fourth embodiment of a container and closure assembly according to the present invention with the closure fully secured on the container neck.

Referring to FIG. 5, the container and closure assembly according to this embodiment also comprises a tamper-evident safety feature as described and claimed in our International Patent Application W094/11267. The tamper-evident feature is in the form of a tamper-evident ring 73 that is molded integrally with an outer skirt 72 of the container closure and joined thereto by frangible bridges (not shown). The tamper-evident ring comprises a plurality of integrally formed, flexible, radially inwardly pointing retaining tabs 74 that are retained under a circumferential lip on the container neck. The use of these inwardly projecting tabs makes it easier initially to snap-fit the cap and tamper evident ring onto the container neck without damaging the tamper-evident ring, since the tabs can flex outwardly as the ring is pushed onto the neck.

The container and closure assembly according to the embodiment of FIG. 5 also comprises means substantially as described in copending patent application WO02/42171 (the entire content of which is incorporated herein by reference) for forming a gas-tight seal between the closure and the container neck when the closure is fully secured on the neck.

The sealing arrangement comprises an inwardly tapered inner surface of the container neck adjacent to the lip 66 of the container neck. Typically, the angle of taper is from about 1 degree to about 10 degrees. A cylindrical sealing plug 75 (located radially outside the threaded plug) projects downwardly from the base of the closure cap 71, and is itself tapered substantially in parallel with the inner surface of the neck. However, instead of a simple interference fit between the sealing plug and the container neck, there is provided a substantially circumferential continuous sealing rib 71 on the outer surface of the sealing plug 75. The circumferential sealing rib 71 has a substantially equilateral triangular cross-section, and is approximately 150 micrometers high, in the unstressed state. However, it deforms when pressed against the normally harder material (glass or PET) of the container neck to form the pressure-tight seal. The small dimensions of the sealing rib enable a pressure tight seal to be achieved without substantial force having to be applied to the sealing plug to form the seal.

Two flexible sealing fins 76,77 extend downwardly by about 2 mm from the base of the closure 71 between the closure skirt 72 and the sealing plug 75. The sealing fins flex in opposite directions to form seals substantially symmetrically on either side of the rounded top of the container lip as the sealing position is reached. A tight seal is assured by abutment of the sealing fins 76,77 against respective stop surfaces on the inside of the closure cap.

Finally, a further circumferential sealing rib 79 is provided on the inside surface 78 of the closure skirt 72, for engagement with an outer surface of the container neck close to the lip. The unstressed shape and size of the sealing rib 79 on the sealing skirt are preferably similar to the preferred ranges for the sealing rib on the sealing plug. In use, the sealing ribs 71 and 79 cooperate to pinch the container lip to provide highly effective seals over a wide range of temperature and pressure.

Referring to FIGS. 6 and 7, the container and closure according to this embodiment are dimensioned and configured substantially as described for the embodiment of FIGS. 1 and 2. However, the closure 80 in the embodiment of FIGS. 6 and 7 comprises a threaded sealing plug 82 that is provided with a floor 84 instead of the base 30 in the embodiment of FIGS. 1 and 2. The resulting compartment inside closure 80 is filled with a dehydrated beverage ingredient or snack food 88, and sealed by thermally bonding a sheet of heat-sealable film 86 over the top of the closure 80. The film 86 may be peeled off to release the contents 88 either before or after removal of the closure from the container neck.

The above embodiments have been described by way of example only. Many other embodiments of the present invention falling within the scope of the accompanying claims will be apparent to the skilled reader. In particular, the present invention is not limited to carbonated beverage containers, or to containers formed from molded thermoplastics.

The invention claimed is:

1. A container neck and closure assembly, wherein the container neck comprises a single piece of material including a substantially smooth outer surface and first screw thread formed in the internal surface of the single piece of material and the closure comprises a cylindrical plug for insertion into the container neck, said plug having a second screw thread on an outer surface thereof for engagement with the first screw thread wherein:

the closure can be secured and resecured on the neck by a single smooth rotation through about 360° or less;

the first screw thread is formed integrally with the container neck by moulding of thermoplastic material and comprises at least four first thread segments that do not overlap circumferentially around the container neck;

the second screw thread comprises a plurality of second thread segments that are longer than said first thread segments and that define a continuous helical thread path along which the first thread segments travel from a fully disengaged to a fully secured position of the closure on the container neck;

the first and second threads are multiple-start threads having a number of thread starts equal to the number of first thread segments;

wherein the cylindrical plug on the closure and the container neck comprises complementary circumferential sealing surfaces below the threads, whereby the cylindrical plug forms a sealing interference fit with the neck below the threads when the closure is fully secured on the container neck; and wherein the container and closure further comprise complementary locking elements on the internal surface of the container neck and on the external surface of the closure that block or resist unscrewing of the closure from the fully secured position on the container neck until a predetermined minimum opening torque is applied.

2. A container closure assembly according to claim 1, wherein the closure can be secured and resecured on the container neck by a single smooth rotation through about 180° or less.

3. A container closure assembly according to claim 1, wherein the first and second threads are selected from the group consisting of multiple start threads, 4-start threads, and 6-start threads.

4. A container closure assembly according to claim 2, wherein the first and second threads are selected from the group consisting of multiple start threads, 4-start threads, and 6-start threads.

5. A container closure assembly according to claim 1, wherein the first and second threads are substantially continuous helical threads.

6. A container closure assembly according to claim 1, wherein the first thread comprises a plurality of relatively short thread segments and the second thread comprises a plurality of relatively long thread segments.

7. A container neck and closure assembly according to claim 1, further comprising one or more circumferential sealing elements on the closure for forming a seal against the container neck when the closure is secured on the container neck.

8. A container neck and closure assembly according to claim 1, wherein the first thread is formed integrally with the container neck by moulding of a thermoplastic material.

9. A container closure assembly according to claim 1, wherein the complementary locking elements longitudinally overlap the first or the second thread segments when the closure is in the fully engaged position on the container neck.

10. A container closure assembly according to claim 1, further comprising a projecting stop surface on one of the internal surface of the container neck of the external surface of the closure skirt for abutment against a second stop or a thread on the other of the container neck or the closure to block ever-tightening of a closure beyond a predetermined angular sealing position of the closure on the container neck.

11. A container closure assembly according to claim 1, further comprising a projecting stop surface on one of the internal surface of the container neck of the external surface of the closure skirt for abutment against a second stop or a thread on the other of the container neck or the closure to block ever-tightening of a closure beyond a predetermined angular sealing position of the closure on the container neck.

12. A container closure assembly according to claim 1, further comprising mutually engageable elements on the internal surface of the neck and on the external surface of the neck and on the external surface of the closure to block or restrict rotation of the closure in an unscrewing direction beyond an intermediate position when the closure is under axial pressure in a direction emerging from the container neck.

13. A container closure assembly according to claim 1, further comprising mutually engageable elements on the internal surface of the neck and on the external surface of the neck and on the external surface of the closure to block or restrict rotation of the closure in an unscrewing direction beyond an intermediate position when the closure is under axial pressure in a direction emerging from the container neck.

14. A container closure assembly according to claim 13, wherein said first and second screw threads are constructed and arranged to permit axial displacement of said closure relative to said container neck at least when said closure is at said intermediate position, and wherein said engageable elements engage each other when said closure is axially displaced in a direction emerging from said container neck, and wherein said mutually engageable elements are constructed and arranged not to mutually engage each other when said closure is axially displaced in a direction inwardly towards said container neck at said intermediate position.

15. A container closure assembly according to claim 14, wherein said first and second screw threads are constructed and arranged to permit axial displacement of said closure relative to said container neck at least when said closure is at said intermediate position, and wherein said engageable elements engage each other when said closure is axially displaced in a direction emerging from said container neck, and wherein said mutually engageable elements are constructed and arranged not to mutually engage each other when said closure is axially displaced in a direction inwardly towards said container neck at said intermediate position.

16. A container closure assembly according to claim 13, wherein said first and second screw threads each comprise at least one thread segment, and the mutually engageable elements comprise a step or recess formed in one of said first or second screw thread segments to provide a first abutment surface against which a second abutment surface on the other one of said second or first screw segments, respectively, abuts to block or restrict rotation of said closure in an unscrewing direction at said intermediate position when said closure is under axial pressure in a direction emerging from said container neck.

17. A container closure assembly according to claim 14, wherein said first and second screw threads each comprise at least one thread segment, and the mutually engageable elements comprise a step or recess formed in one of said first or second screw thread segments to provide a first abutment surface against which a second abutment surface on the other one of said second or first screw segments, respectively, abuts to block or restrict rotation of said closure in an unscrewing direction at said intermediate position when said closure is under axial pressure in a direction emerging from said container neck.

18. A container closure assembly according to claim 1, wherein the cylindrical plug is hollow and closed at the bottom to define a compartment inside the closure cap, and an opening into the compartment is provided in the base of the closure opposite the plug.

19. A container closure assembly according to claim 7, wherein the cylindrical plug is hollow and closed at the bottom to define a compartment inside the closure cap, and an opening into the compartment is provided in the base of the closure opposite the plug.

20. A container having a container body, and a neck sealed by a container closure assembly according to claim 1.

21. A container having a container body, and a neck sealed by a container closure assembly according to claim 1.

22. A container according to claim 21, wherein the container contains a carbonated beverage, and the container closure assembly seals the container in pressure-tight fashion.

23. A container according to claim 22, wherein the container contains a carbonated beverage, and the container closure assembly seals the container in pressure-tight fashion.

24. A container according to claim 21, wherein the container neck projects from the container body by at least about 1 cm, and wherein the container neck has a substantially smooth outer surface extending for a distance of at least about 1 cm below the lip of the container neck.

25. A container according to claim 22, wherein the container neck projects from the container body by at least about 1 cm, and wherein the container neck has a substantially smooth outer surface extending for a distance of at least about 1 cm below the lip of the container neck.

26. A container according to claim 23, wherein the container neck projects from the container body by at least about 1 cm, and wherein the container neck has a substantially smooth outer surface extending for a distance of at least about 1 cm below the lip of the container neck.

27. A container according to claim 24, wherein the container neck projects from the container body by at least about 1 cm, and wherein the container neck has a substantially smooth outer surface extending for a distance of at least about 1 cm below the lip of the container neck.

* * * * *